US008516732B2

(12) United States Patent
Burnsed, Jr.

(10) Patent No.: US 8,516,732 B2
(45) Date of Patent: Aug. 27, 2013

(54) DETACHABLE SWIVEL AND ASSOCIATED MOUNT

(75) Inventor: Ashley A. Burnsed, Jr., Port Wentworth, GA (US)

(73) Assignee: Blue Force Gear, Inc., Savannah, GA (US)

( * ) Notice: Subject to any disclaimer, the term of this patent is extended or adjusted under 35 U.S.C. 154(b) by 0 days.

(21) Appl. No.: 13/325,828

(22) Filed: Dec. 14, 2011

(65) Prior Publication Data

US 2012/0174458 A1 Jul. 12, 2012

Related U.S. Application Data

(60) Provisional application No. 61/422,875, filed on Dec. 14, 2010.

(51) Int. Cl.
*F41C 23/02* (2006.01)
*A44B 18/00* (2006.01)
*F16B 17/00* (2006.01)

(52) U.S. Cl.
USPC ..... 42/85; 24/573.11; 403/322.2; 411/348

(58) Field of Classification Search
USPC ..... 42/85; 24/573.11, 648; 403/322.2; 411/348
See application file for complete search history.

(56) References Cited

U.S. PATENT DOCUMENTS

| | | | | |
|---|---|---|---|---|
| 2,480,662 | A * | 8/1949 | McKinzie | 42/85 |
| 2,642,689 | A * | 6/1953 | Cline | 42/85 |
| 4,571,872 | A | 2/1986 | Johnson | |
| 5,067,267 | A | 11/1991 | Ives | |
| 5,394,594 | A * | 3/1995 | Duran | 24/453 |
| 5,692,654 | A * | 12/1997 | Bell | 224/150 |
| 6,152,645 | A * | 11/2000 | Sanford | 403/328 |
| 6,354,034 | B1 | 3/2002 | Norris, Sr. | |
| 6,511,100 | B1 * | 1/2003 | Le Clinche | 285/316 |
| 7,654,027 | B1 | 2/2010 | Grover | |
| 7,654,028 | B1 | 2/2010 | Grover | |
| 7,814,697 | B2 | 10/2010 | Esch | |
| 2006/0254113 | A1 * | 11/2006 | Esch | 42/85 |

FOREIGN PATENT DOCUMENTS

KR 2019940025966 12/1994

OTHER PUBLICATIONS

Search Report and Written Opinion for International Application No. PCY/US2011/064939 mailed Aug. 28, 2012.

* cited by examiner

*Primary Examiner* — Bret Hayes

(74) *Attorney, Agent, or Firm* — Sutherland Asbill & Brennan LLP

(57) ABSTRACT

Embodiments of the invention relate to a detachable swivel and associated mount. In one embodiment, a detachable swivel can be provided. The detachable swivel can include a housing with an axial cavity; at least one retention device; and an internal body operable to mount within the axial cavity, the internal body operable to contact the at least one retention device, wherein the internal body axially translates within the axial cavity between a first position and a second position; wherein an axial force applied to a portion of the internal body and away from the housing causes the internal body to translate between the first and second position.

19 Claims, 12 Drawing Sheets

DETACHABLE SWIVEL AND ASSOCIATED MOUNT

RELATED APPLICATION

This application claims priority to U.S. Provisional Application Ser. No. 61/422,875, filed on Dec. 14, 2010, the contents of which are incorporated by reference.

TECHNICAL FIELD

The invention relates generally to mounting devices, and more particularly to a detachable swivel and associated mount.

BACKGROUND OF THE INVENTION

Conventional swivels can be used for a variety of equipment and objects, including firearms, weapons, safety items, life support products, emergency-type items, and common household goods. In certain instances, conventional swivels can be used to connect firearm sling to a firearm, such as an AR-15 or M-4. For example, a conventional swivel can be mounted to a forearm end or barrel of an AR-15 or other firearm and another conventional swivel can be mounted to a butt end or butt stock portion of the AR-15 or firearm. The conventional swivels can connect to opposing ends of a firearm sling, and the sling can be worn by a user to shoulder or otherwise carry the AR-15 or other firearm. An example conventional swivel is shown as 100 in FIG. 1.

In some instances, conventional swivels can be detached from the equipment or object they are mounted to by way of a push button release or rotating mechanism. In the example conventional swivel shown in FIG. 1, a rounded knob 130 can be rotated in either direction to retract a series of bearings 150 located in a lower portion 110 of the swivel. In other instances, a push button release located on the knob or side of the knob can be pushed to similarly retract a series of bearings located in a lower portion of the swivel. In any instance, due to the relative size of the release mechanisms involved, the manual operations of either rotating the knob or pushing a push button release on conventional swivels may be inconvenient or physically difficult to perform in certain circumstances. For example, if a user is wearing a sling mounted to a firearm via a conventional swivel 100 and sling loop 160, and the user becomes trapped or has limited movement, such as in a vehicular crash or when the physical environment is restrictive, releasing the sling and firearm from the user's body may be difficult or impossible if the user cannot rotate the knob or push the push button release associated with a conventional swivel to which the sling and sling loop 160 may be mounted to. In this example, failure to release the sling, sling loop 160, and firearm may lead to subsequent death or further injury to the user.

SUMMARY OF THE INVENTION

Embodiments of the invention can provide some or all of the above needs. Certain embodiments of the invention can provide a detachable swivel, an associated mount, and associated methods for making or using the swivel and/or associated mount. In one embodiment, a detachable swivel can be provided. The detachable swivel can include a housing with an axial cavity; at least one retention device; and an internal body operable to mount within the axial cavity, the internal body operable to contact the at least one retention device, wherein the internal body axially translates within the axial cavity between a first position and a second position; wherein an axial force applied to a portion of the internal body and away from the housing causes the internal body to translate between the first and second position.

In one aspect of an embodiment, a detachable swivel can further include at least one spring operable to disposed between the internal body and the housing, wherein the spring biases the internal body towards the first position.

In one aspect of an embodiment, a detachable swivel can further include a mounting device operable to connect to the housing.

In one aspect of an embodiment, a detachable swivel can further include a mounting device operable to connect to an exposed end of the internal body when the internal body is mounted within the internal cavity.

In one aspect of an embodiment, the at least one retention device can include one or more bearings disposed between the internal body and the housing, wherein the one or bearings can extend from an outer surface of the housing when the internal body is in the first position and retract within the outer surface of the housing when the internal body is in the second position.

In one aspect of an embodiment, the first position is a locked position, and the second position is an unlocked position.

In one aspect of an embodiment, the housing is operable to mount to a corresponding hole in an object which can include at least one of the following: a firearm, a weapon, a sling, a belt, a carrying device, a garment, a safety item, a life support product, an emergency-type item, or a common household good.

In another embodiment, a detachable swivel for mounting to an object can be provided. The detachable swivel can include a housing with an axial cavity, the housing can include one or more detent devices which can extend or retract from an outer surface of the housing, the one or more detent devices operable to mount within a circumferential groove in the object. The detachable swivel can also include an internal body operable to mount within the axial cavity, the internal body operable to contact the one or more detent devices, wherein the internal body axially translates within the axial cavity between a first position and a second position, and the internal body further operable to connect to a second object; wherein an axial force applied to a portion of the internal body and away from the housing causes the internal body to translate between the first and second position.

In one aspect of an embodiment, a detachable swivel can further include at least one spring operable to disposed between the internal body and the housing, wherein the spring biases the internal body towards the first position.

In one aspect of an embodiment, a detachable swivel can further include a mounting device operable to connect to the housing.

In one aspect of an embodiment, a detachable swivel can further include a mounting device operable to connect to an exposed end of the internal body when the internal body is mounted within the internal cavity.

In one aspect of an embodiment, the one or more detent devices can include one or more bearings disposed between the internal body and the housing, wherein the one or bearings can extend from an outer surface of the housing when the internal body is in the first position and retract within the outer surface of the housing when the internal body is in the second position.

In one aspect of an embodiment, the first position is a locked position, and the second position is an unlocked position.

In one aspect of an embodiment, the object can include at least one of the following: a firearm, a weapon, a sling, a belt, a carrying device, a garment, a safety item, a life support product, an emergency-type item, or a common household good.

In another embodiment, a method for manipulating a detachable swivel with respect to an object can be provided. The method can include inserting a detachable swivel into an object with a groove, wherein the detachable swivel can include a housing with an axial cavity; at least one retention device; and an internal body operable to mount within the axial cavity, the internal body operable to contact the at least one retention device, wherein the internal body axially translates within the axial cavity between a first position and a second position. The method can also include engaging the groove via the at least one retention device. Further, the method can include applying an axial force to a portion of the internal body and away from the housing to cause the internal body to translate between the first and second position. Furthermore, the method can include removing the detachable swivel from the object or groove.

In one aspect of an embodiment, a detachable swivel can further include at least one spring operable to disposed between the internal body and the housing, wherein the spring biases the internal body towards the first position.

In one aspect of an embodiment, a detachable swivel can further include a mounting device operable to connect to an exposed end of the internal body when the internal body is mounted within the internal cavity.

In one aspect of an embodiment, applying an axial force to a portion of the internal body and away from the housing can include applying an axial force to the mounting device.

In one aspect of an embodiment, the at least one retention device can include one or more bearings disposed between the internal body and the housing, wherein the one or bearings can extend from an outer surface of the housing when the internal body is in the first position and retract within the outer surface of the housing when the internal body is in the second position.

In one aspect of an embodiment, the first position is a locked position, and the second position is an unlocked position.

In one aspect of an embodiment, the object can include at least one of the following: a firearm, a weapon, a sling, a belt, a carrying device, a garment, a safety item, a life support product, an emergency-type item, or a common household good.

In another embodiment, a mount for the swivel can be provided. The mount for a swivel can include a body, a mounting cavity in the body, a retention cable, and a set of cable end caps. The mounting cavity can be operable to receive an internal body associated with a detachable swivel, wherein the internal body can include at least one retention device and the at least one retention device can contact a portion of the mounting cavity. The internal body can be configured to axially translate with respect to a housing associated with the detachable swivel, wherein an axial force applied to a portion of the internal body and away from the housing causes the internal body to translate between a first and a second position.

In yet another embodiment, a method for using the mount can be provided.

In another embodiment, a sling can be provided.

In yet another embodiment, a method for using the sling can be provided.

Other systems, methods, apparatus, features, and aspects according to various embodiments of the invention will become apparent with respect to the remainder of this document.

BRIEF DESCRIPTION OF DRAWINGS

Figure 1:
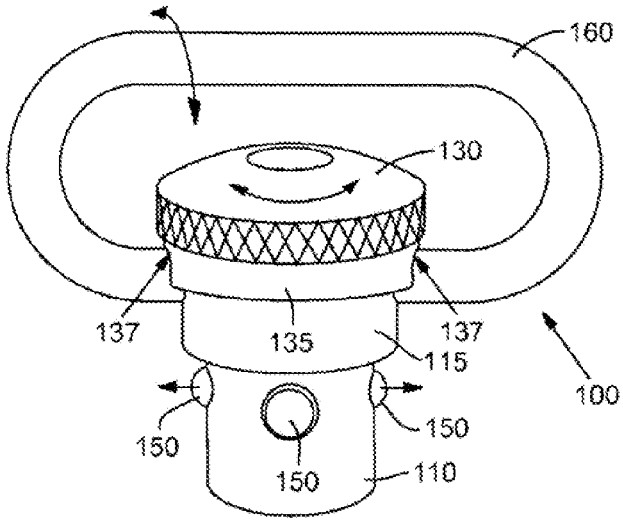
FIG. 1 (PRIOR ART)

Having thus described embodiments of the invention in general terms, reference will now be made to the accompanying drawings, which are not drawn to scale, and wherein:

FIG. 1 illustrates a conventional swivel, known as a twist-lock sling swivel.

Figure 2:
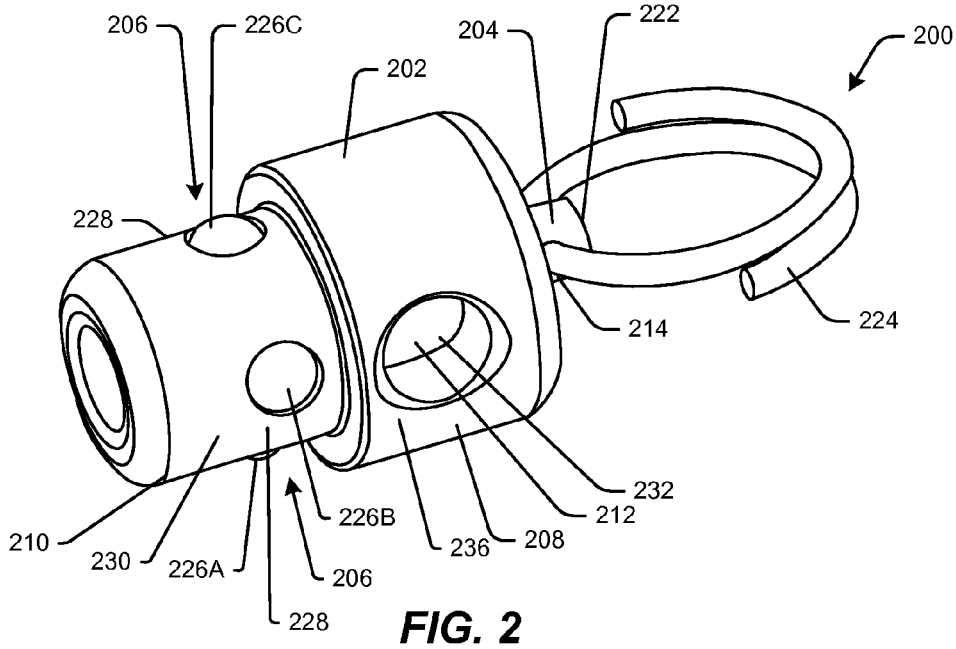

FIG. 2 illustrates an example detachable swivel in accordance with an embodiment of the invention.

Figure 3:
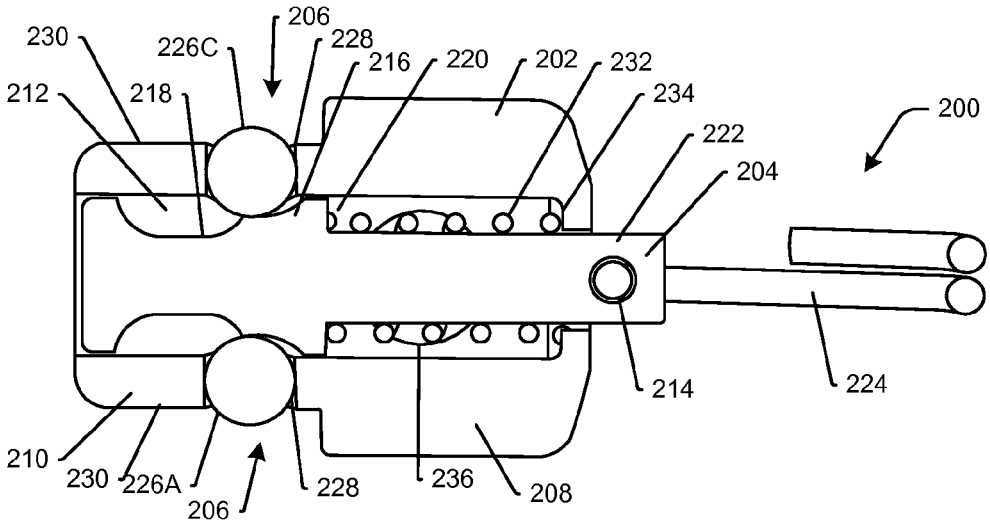

FIG. 3 illustrates a side sectional view of the detachable swivel shown in FIG. 2.

Figure 4:
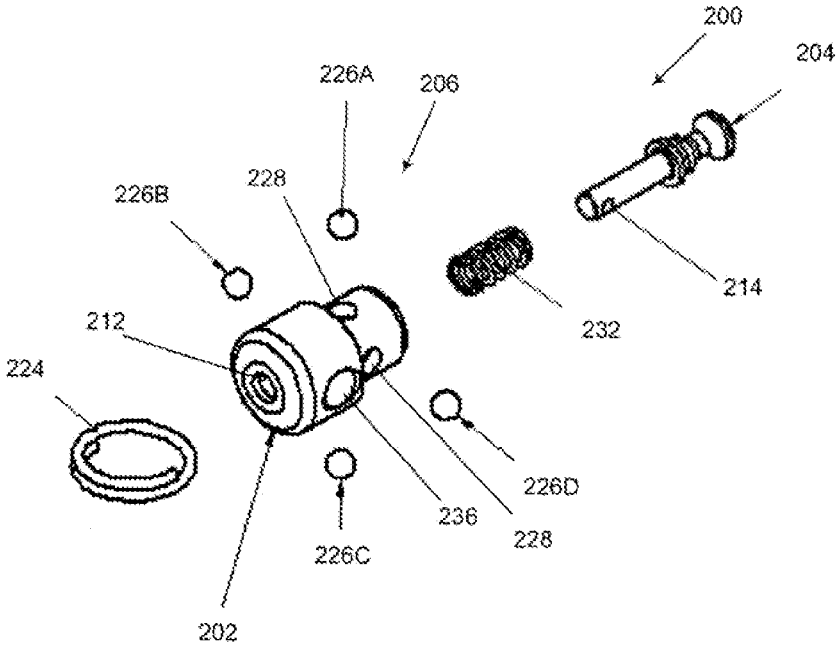

FIG. 4 illustrates an exploded view of the detachable swivel shown in FIG. 2.

Figure 5:
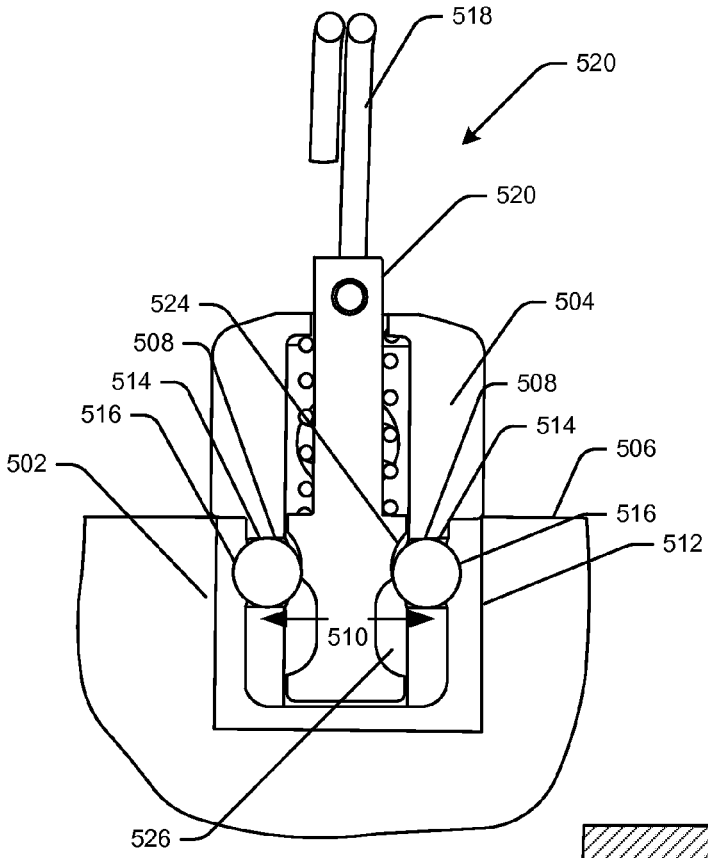

FIG. 5 illustrates an example detachable swivel in a locked position within a corresponding socket hole in accordance with an embodiment of the invention.

Figure 6:
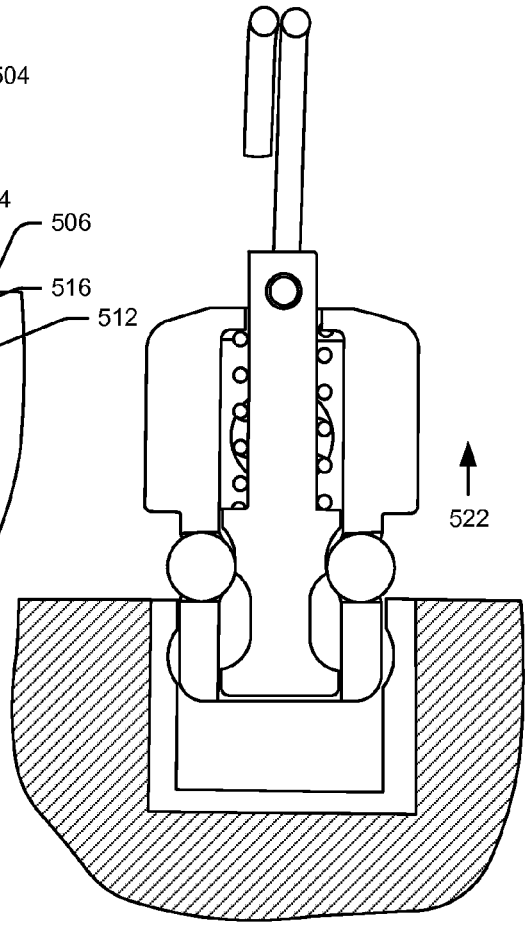

FIG. 6 illustrates the example detachable swivel of FIG. 5 in an unlocked position within a corresponding socket hole in accordance with an embodiment of the invention.

Figure 8:
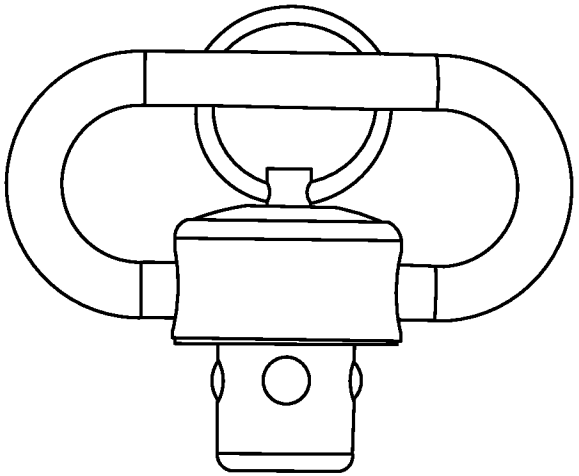
Figure 7:
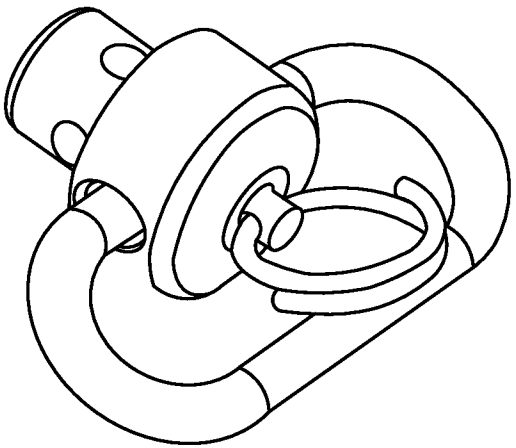

FIGS. 7-8 illustrate another example detachable swivel in accordance with an embodiment of the invention.

Figure 9:
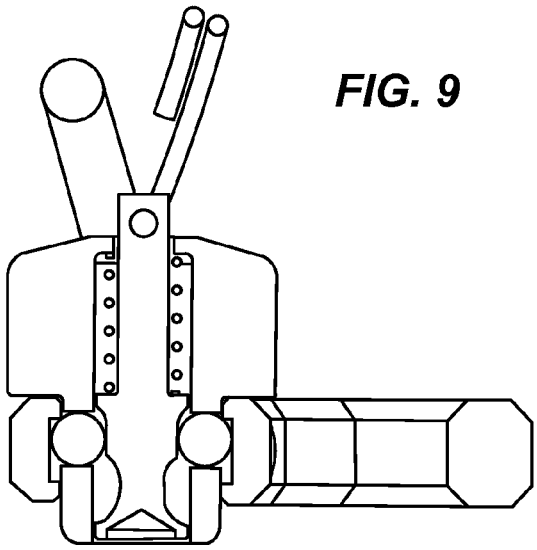
Figure 10:
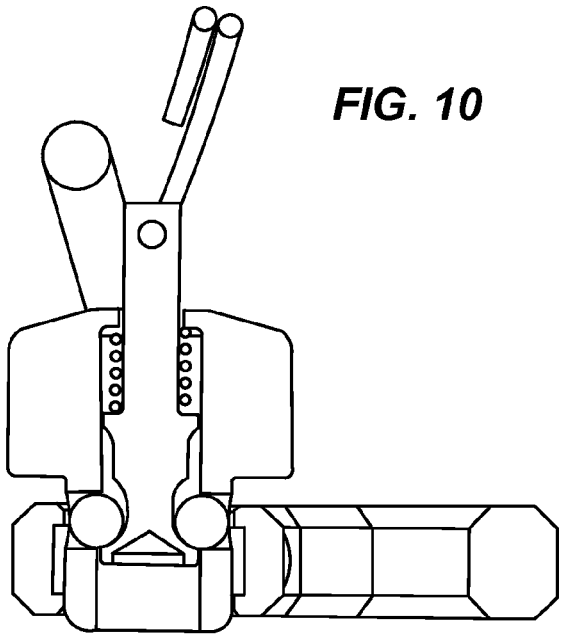

FIGS. 9 and 10 illustrate an example use of the detachable swivel shown in FIGS. 7-8 in accordance with an embodiment of the invention.

Figure 11:
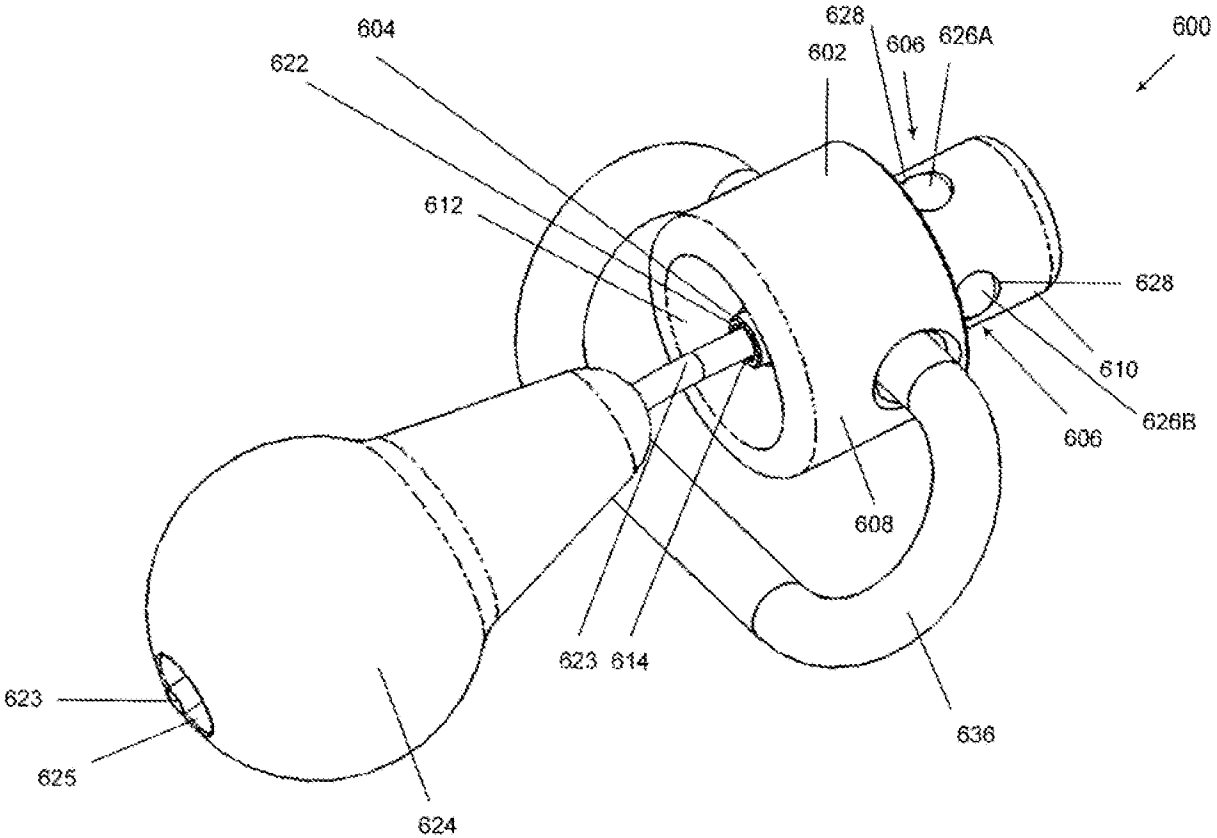
Figure 12:
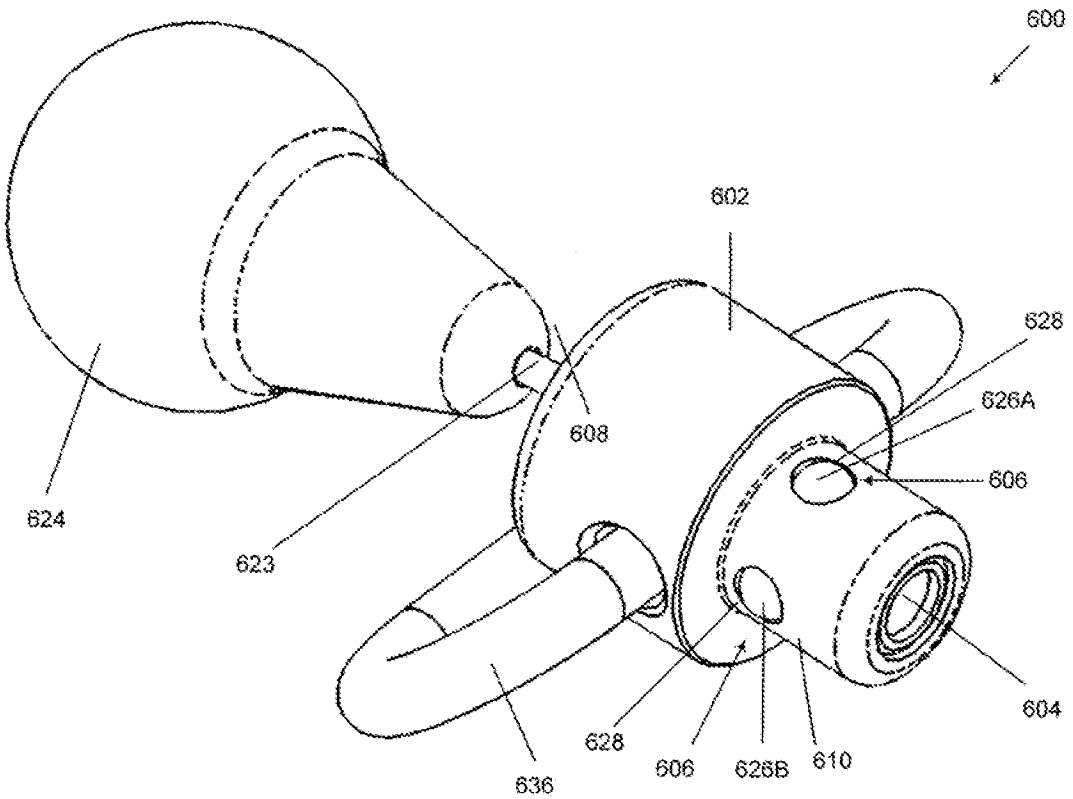
Figure 13:
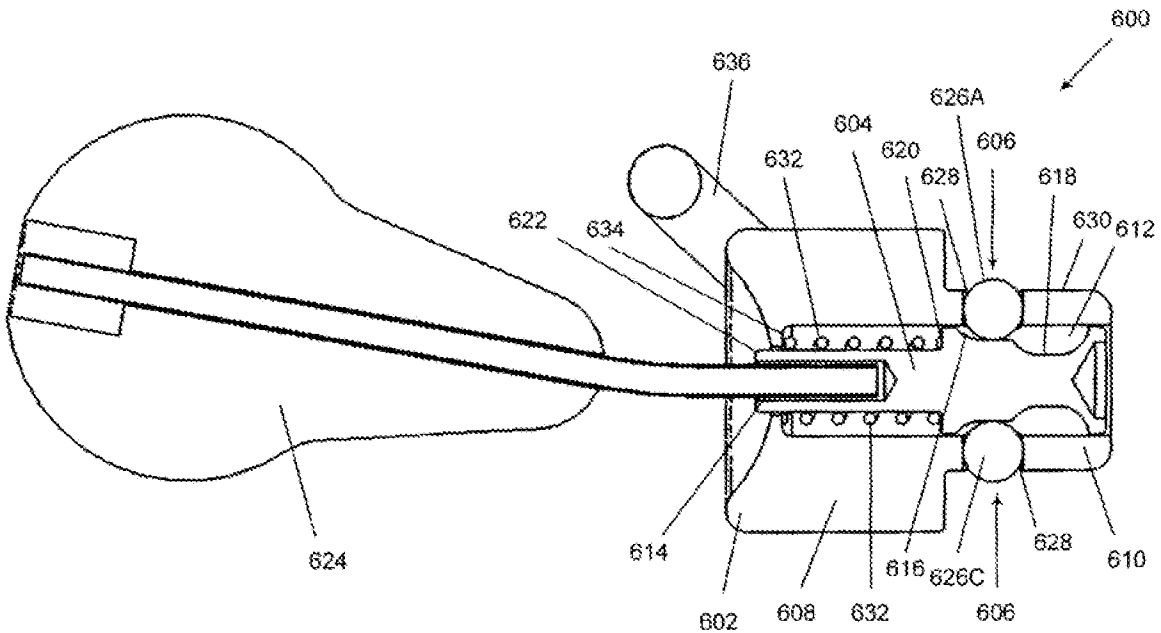

FIGS. 11-13 illustrate another example detachable swivel in accordance with an embodiment of the invention.

Figure 14:
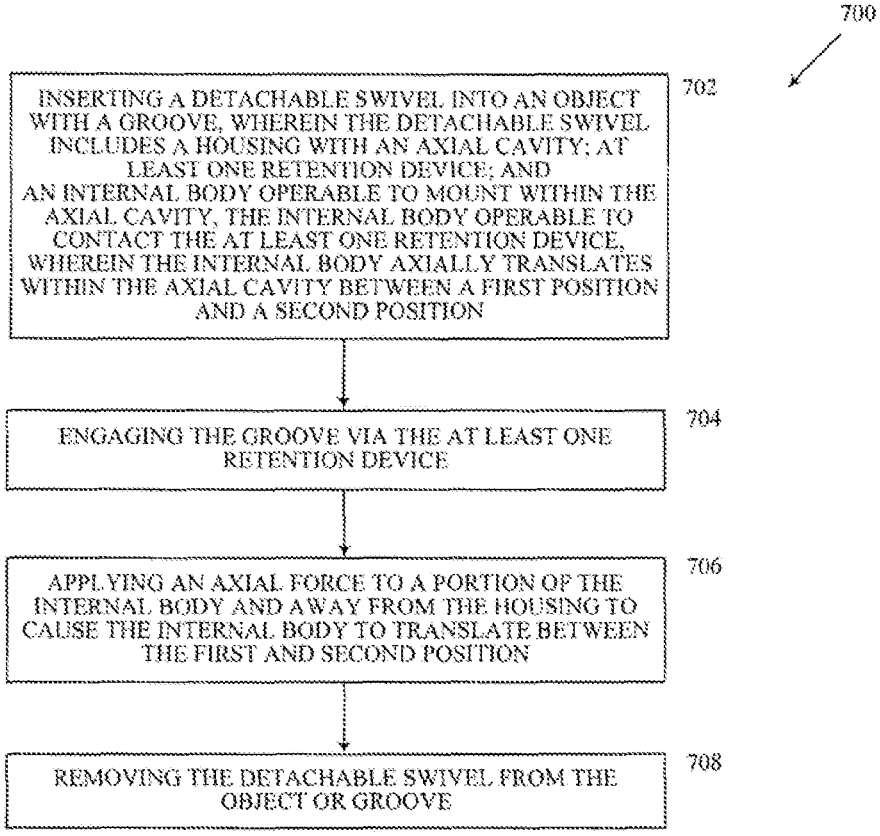

FIG. 14 illustrates an example method for using a detachable swivel in accordance with an embodiment of the invention.

Figure 15:
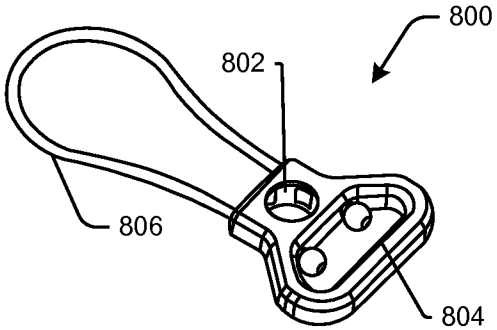
Figure 17:
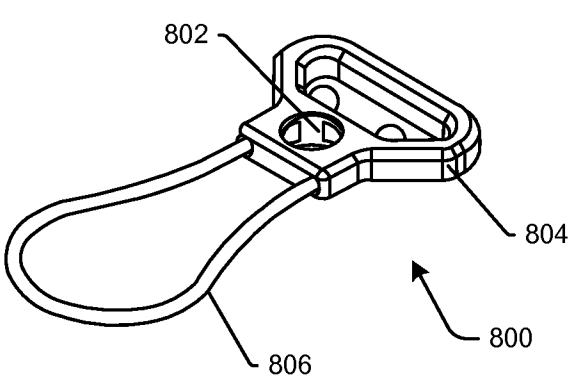
Figure 16:
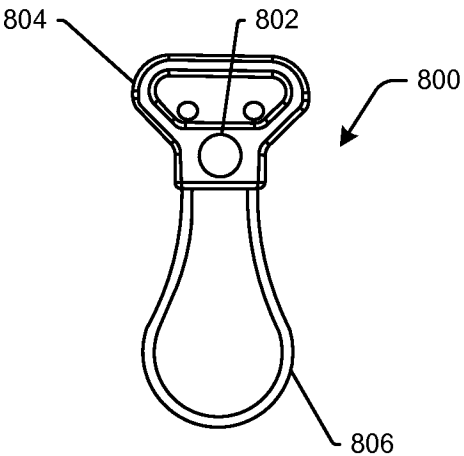

FIGS. 15-17 illustrate an example mount for a detachable swivel in accordance with an embodiment of the invention.

Figure 18:
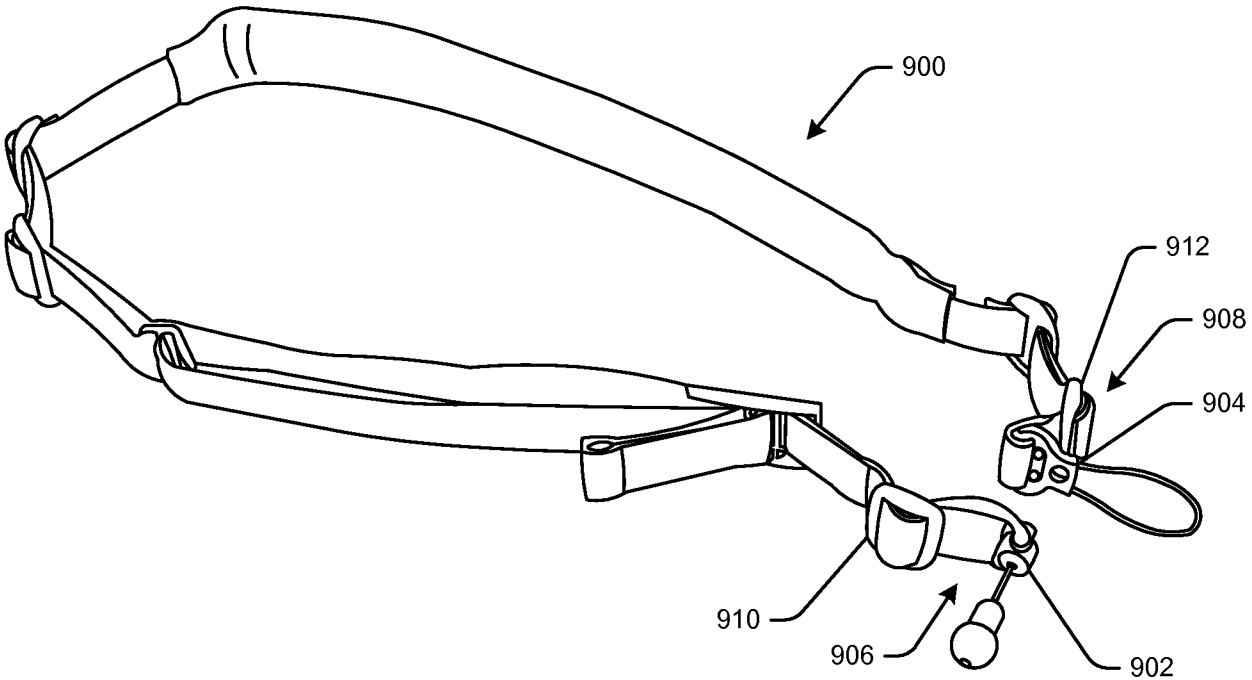
Figure 19:
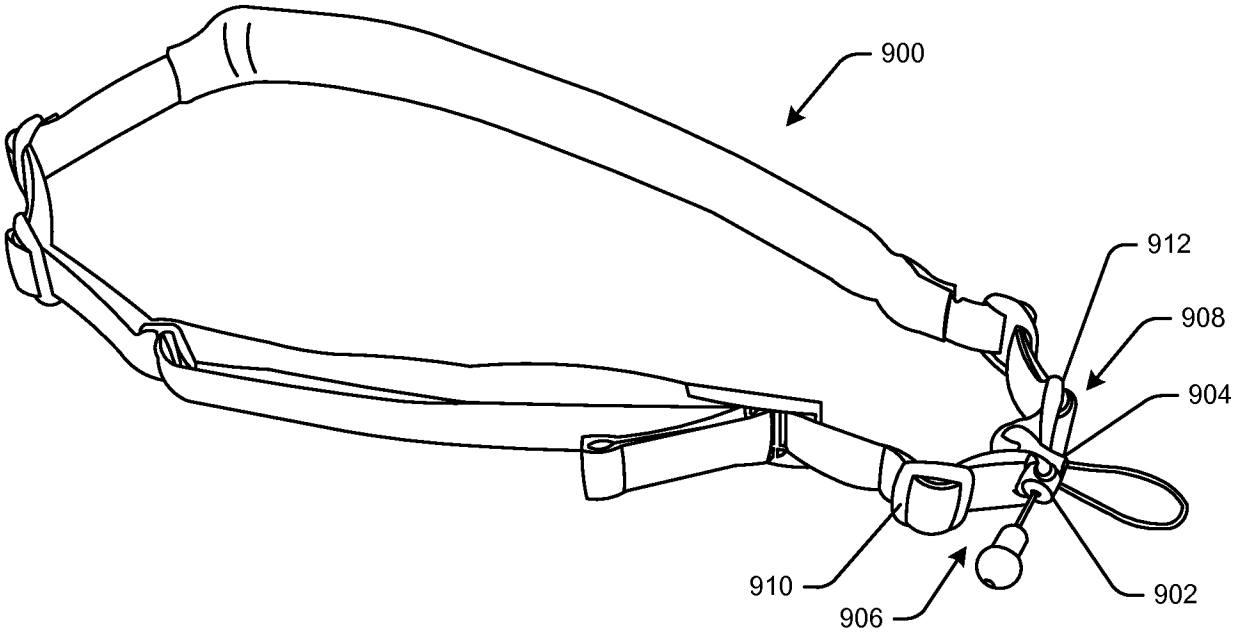

FIGS. 18-19 illustrate an example sling with a detachable swivel and mount in accordance with an embodiment of the invention.

DETAILED DESCRIPTION OF EMBODIMENTS OF THE INVENTION

Embodiments of the invention now will be described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention. Like numbers refer to like elements throughout.

Certain embodiments of the invention generally provide for a detachable swivel and associated methods for making and using the swivel. Certain embodiments described herein can provide a detachable swivel for equipment or an object, such as a firearm. One technical effect and/or solution of certain embodiments of a detachable swivel can provide a relatively easier or quicker releasing or detaching mechanism. In some instances, a push button or rotating release mechanism for a swivel can be relatively difficult or impossible to operate during extreme conditions, such as a vehicle crash or restrictive physical environments. One technical effect and/or solution of certain embodiments of a detachable swivel can provide a pull-type release mechanism associated with a detachable swivel, thus facilitating a relatively quick release or detachment of the swivel from an object, such as a firearm or a sling. In one example embodiment, a detachable swivel connecting a firearm and a sling can be quickly released from the firearm or the sling by way of pulling the swivel, wherein a user can remove the firearm and/or sling from his or her body.

Certain embodiments of the invention generally provide for an associated mount for a detachable swivel and associated methods for making and using the associate mount. Certain embodiments described herein can provide a mount for a detachable swivel used with equipment or an object, such as a sling or a firearm. For example, an example mount is shown in FIGS. 15-17, and an example mount associated with a sling for a firearm is shown in FIGS. 18 and 19. One technical effect and/or solution of certain embodiments of a mount for a detachable swivel can provide a receiving device for a relatively easier or quicker releasing or detaching mechanism. In some instances, a push button or rotating release mechanism for a swivel can be relatively difficult or impossible to operate during extreme conditions, such as a vehicle crash or restrictive physical environments. One technical effect and/or solution of certain embodiments of a mount for a detachable swivel can provide a receiving device for a pull-type release mechanism associated with a detachable swivel, thus facilitating a relatively quick release or detachment of the swivel from an object, such as a firearm or a sling.

In one example embodiment, such as shown in FIGS. 18 and 19, a sling for a firearm can be equipped with a detachable swivel and a mount for a detachable swivel to connect opposing ends of the sling together. When the detachable swivel is engaged to the mount, the opposing ends of the sling can be connected via the detachable swivel and the mount. When desired, the opposing ends of the sling can be quickly released from each other by way of pulling the detachable swivel and disengaging the detachable swivel from the mount.

FIGS. 2 and 3 illustrate an example detachable swivel in accordance with an embodiment of the invention. FIG. 4 illustrates an exploded view of the detachable swivel 200 shown in FIGS. 2 and 3. In the example embodiment shown in FIGS. 2-4, a detachable swivel 200 is shown with a housing 202, an internal body 204, and one or more retention devices 206. In this embodiment, the housing 202 includes an upper cylindrical-shaped portion 208 and a lower cylindrical-shaped portion 210. A cylindrical-shaped axial cavity 212, into which the internal body 204 is operable to mount within, extends through both the upper cylindrical-shaped portion 208 and the lower cylindrical-shaped portion 210 of the housing 202. As shown in this embodiment, the internal body 204 can be an elongate-shaped device with an internal body mounting device hole 214, a first position bearing surface 216, a second position bearing surface 218, and a biasing surface 220, wherein the internal body 204 can axially translate within the axial cavity 212. The internal body mounting device hole 214 in an extended or exposed end 222 of the internal body 204 can be operable to receive a mounting device, such as a split ring 224 or cotter ring, when the internal body 204 is mounted within the axial cavity 212.

In one embodiment, the internal body can mount to a device for pulling the internal body in an axial direction. Examples of a device for pulling the internal body in an axial direction can include, but are not limited to, a threaded device, an eye loop, and a flexible cable.

In one embodiment, a housing such as 202 can be made from a stainless steel alloy.

In one embodiment, an internal body such as 204 can be made from a stainless steel alloy with an approximate length of 0.813 inches.

In one embodiment, a mounting device such as a split ring 224 can be made from zinc-plated steel with an outer diameter of about 0.740 inches, an inner diameter of about 0.596 inches, and a thickness of about 0.105 inches.

Each of the first position bearing surface 216, the second position bearing surface 218, and the biasing surface 220 can be formed or otherwise machined in an external surface of the internal body 204, wherein the first position bearing surface 216 and second position bearing surface 218 are operable to contact one or more of the retention devices 206. The one or more retention devices 206, such as a series of bearings 226A-226D, can be disposed between the internal body 204 and corresponding protrusions or holes 228 in the lower cylindrical-shaped portion 210 of the housing 202. One will recognize that any number of retention devices or bearings can be used in accordance with embodiments of invention, and the selection of the number may depend on the size of the associated swivel. When the internal body 204 is moved to a first position with respect to the housing 202, such as shown in FIGS. 2 and 3 as well as FIG. 5 described below, the one or more retention devices, such as bearings 226A-226D, can contact or otherwise seat against the first position bearing surface 216 of the internal body 204. Likewise, when the internal body 204 is moved to a second position with respect to the housing 202, such as shown in FIG. 6 described below, the one or more retention devices, such as bearings 226A-226D, can contact or otherwise seat against the second position bearing surface 218 of the internal body 204. As shown in FIG. 3, the relative depth of the first position bearing surface 216 is less than the depth of the second position bearing surface 218, thus when one or more bearings 226A-226D are in contact with a first bearing surface, such as 216, a portion of the bearings 226A-226D may extend outward from the protrusions or holes 228 in the lower cylindrical-shaped portion 210 and past an external surface 230 of the housing 202. Likewise, when one or more bearings 226A-226D are in contact with a second bearing surface, such as 218, a portion of the bearings 226A-226D may extend into the protrusions or holes 228 in the lower cylindrical-shaped portion 210 but remain retracted within the external surface 230 of the housing 202. Thus, when an axial force is applied to a portion of the internal body 204, such as an extended or exposed end 222 and away from the housing 202, the internal body 204 can axially translate within the axial cavity 212 between the first position and second position.

In one embodiment, each of a set of bearings such as 226A-226D can be made from stainless steel.

In certain embodiments, such as the embodiment shown in FIGS. 2-4, a detachable swivel 200 can include a spring 232 disposed or otherwise positioned between the biasing surface 220 of the internal body 204 and an internal surface 234 of the upper cylindrical-shaped portion 208 of the housing 202. Generally, the spring 232 is operable to bias the internal body 204 towards a first position with respect to the housing 202. When the internal body 204 is moved to a first position, such as shown in FIGS. 2, 3, and 5, with respect to the housing 202, the spring 232 can maintain a predefined force on the biasing surface 220 of the internal body 204 and can further maintain an opposing predefined force on the internal surface 234 of the upper cylindrical-shaped portion 208 of the housing 202. When the internal body 204 is moved to a second position, such as shown in FIG. 6, with respect to the housing 202, the spring 232 compresses and an increased force is applied to the biasing surface 220 of the internal body 204 and an opposing increased force is applied to the internal surface 234 of the upper cylindrical-shaped portion 208 of the housing 202.

In one embodiment, a spring such as 232 can be a coil-type compression spring made from 302 stainless steel, with a wire diameter of about 0.026 inches and approximately 9/16 inches in length (uncompressed).

In the embodiment shown in FIGS. 2-4, one or more housing mounting holes 236 can be formed in the upper cylindrical-shaped portion 208 of the housing 202. For example, a pair of housing mounting holes 236 can be formed or otherwise machined on opposing lateral sides of the housing 202. In any instance, these mounting holes 236 can be operable to receive a mounting device, such as a sling loop, similar to 160 in FIG. 1, or other sling mounting device.

Other swivel embodiments in accordance with the invention can include fewer or greater numbers of components and may incorporate some or all of the functionality described with respect to the components shown in FIGS. 2-4.

Example methods and processes which can be implemented with an example detachable swivel, such as 200 as well as other embodiments shown in FIGS. 2-4, 7-8, and 11-13, are described by reference to FIGS. 5-6, and 9-10.

FIGS. 5 and 6 illustrate an example use of a detachable swivel 500 in accordance with an embodiment of the invention. In the example embodiment shown, FIG. 5 shows an example detachable swivel 500 in a first or locked position within a corresponding socket hole 502, and FIG. 6 shows the example detachable swivel 500 of FIG. 5 in a second or unlocked position within the corresponding socket hole 502.

Generally, in use, a detachable swivel according to certain embodiments of the invention can be operable to mount to a corresponding hole in an object. For example, the housing 504 of the detachable swivel can fit into a corresponding hole or mounting cavity provided by a mount shown in FIGS. 15-17. By way of another example, the housing 504 of the detachable swivel 500 shown in FIGS. 5 and 6 can mount to a corresponding hole 502 in an object such as a firearm or associated mount 506. In other examples, an object can be a weapon, a sling, a belt, a carrying device, a garment, a safety item, a life support product, an emergency-type item, or a common household good. The hole 502 shown in FIGS. 5 and 6 can be a socket hole in a firearm, such as a socket hole in the buttstock end of a rifle or a socket hole near a forearm end of a rifle. When the detachable swivel 500 is initially aligned for insertion into the hole 502 of the firearm, a set of bearings 508 or detent devices associated with the detachable swivel 500 can extend outward 510 from an external surface 512 of the housing 504. As the housing 504 is inserted into the hole 502, the set of bearings 508 can contact the periphery of the hole 502. The insertion force upon the swivel 500 retracts the set of bearings 508 within the respective holes 514 in the external surface 512 of the housing 504. When the housing 504 is sufficiently inserted into the hole 502, the set of bearings 508 associated with the detachable swivel 500 can extend outward 510, in a first and locked position, from an external surface 512 of the housing 502. In the embodiment shown in FIG. 5, when the housing 504 is sufficiently inserted into the hole 502, the bearings 508 can extend within a circumferential groove 516, or series of corresponding dimples or grooves, within the periphery of the hole 502. In this manner, the housing 504 of the detachable swivel 500 can be maintained within the hole 502.

Typically, a mounting device 518 can be mounted to the detachable swivel 500 by way of an internal body 520 associated with the swivel 500. A sling mounting device similar to 160 in FIG. 1 can also be mounted to the detachable swivel 500 by way of holes or other mounts associated with the housing 504. In another embodiment, a cable and/or pull knob similar to 623, 624 in FIGS. 11-13 can be mounted to a detachable swivel.

When desired, the detachable swivel 500 can be removed from the hole 502. By applying an axial force to the internal body 520, and away from the housing 504, corresponding axial movement of internal body 520 causes the set of bearings 508 to be refracted within the respective holes 514 in the external surface 512 of the housing 504. That is, the set of bearings 508 can be retracted from the first or locked position, shown in FIG. 5, to a second or unlocked position, shown in FIG. 6. In particular, as shown in FIG. 6, as the internal body 520 moves axially (upward direction 522 shown in the drawing) the set of bearings 508 that are initially in contact with a relatively higher first position bearing surface 524 come into contact with a relatively lower second position bearing surface 526 of the internal body 520. In this manner, the set of bearings 508 can retract from the initial, first or locked position, to the subsequent, second or unlocked position. Upon refraction of the set of bearings 508, the housing 504 can be retracted from the hole 502, and thus, the detachable swivel 500 can be removed from the hole 502 or otherwise detached from the firearm 506.

In one embodiment, a swivel can be designed to permit removal of an internal body upon application of a predefined axial force. For example, a predefined axial force can be about 4 pounds of force.

FIGS. 7-8 illustrate another example detachable swivel in accordance with an embodiment of the invention. In the embodiment shown, the internal body can mount to a device for pulling the internal body in an axial direction. Examples of a device for pulling the internal body in an axial direction can include, but are not limited to, a threaded device, an eye loop, a flexible cable, a loop, a ring, and a pull knob.

FIGS. 9 and 10 illustrate an example use of the detachable swivel shown in FIGS. 7-8 in accordance with an embodiment of the invention. In the embodiment shown, when the device is manipulated, the internal body can be retracted from the locked position shown in FIG. 9 to the unlocked position shown in FIG. 10.

FIGS. 11-13 illustrate another example detachable swivel in accordance with an embodiment of the invention. The detachable swivel 600 shown in FIGS. 11-13 can operate similar to the detachable swivel shown in FIGS. 2-10, wherein an internal body of the detachable swivel can mount to a device for pulling the internal body in an axial direction and away from a housing associated with the detachable swivel causing the internal body to translate between a first and a second position. FIGS. 11 and 12 illustrate perspective views of the detachable swivel 600, and FIG. 13 illustrates a side sectional view of the detachable swivel 600 in FIGS. 11 and 12. The detachable swivel 600 is shown with a housing 602, an internal body 604, and one or more retention devices 606. In this embodiment, the housing 602 includes an upper cylindrical-shaped portion 608 and a lower cylindrical-shaped portion 610. An axial cavity 612, into which the internal body 604 is operable to mount within, extends through the upper cylindrical-shaped portion 608 and the lower cylindrical-shaped portion 610 of the housing 602. As shown in this embodiment, the internal body 604 can be an elongate-shaped device with an internal body mounting device 614, a first position bearing surface 616, a second position bearing surface 618, and a biasing surface 620, wherein the internal body 604 can axially translate within the axial cavity 612. The internal body mounting device 614 at extended or exposed end 622 of the internal body 604 can be operable to receive a mounting device, such as a cable 623 mounted to a relatively large pull knob 624, when the internal body 604 is mounted within the axial cavity 612.

In one embodiment, a pull knob such as 624 can have a hole, such as 625, machined through a portion of the knob 624 to receive one end of a cable, such as 623. Once the cable 623 is threaded through the hole 625, the knob 624 can be retained on the cable 623 by a retention device fitted to the cable 623 or by another means or device applied to the cable 623 and/or knob 624. As shown in FIGS. 11-13, a pull knob such as 624 can be shaped with a generally spherical end connected to a conical portion end, wherein the conical portion end is adjacent to the housing 602.

Similar to the embodiment in FIGS. 2-10, each of the first position bearing surface 616, the second position bearing surface 618, and the biasing surface 620 can be formed or otherwise machined in an external surface of the internal body 604, wherein the first position bearing surface 616 and second position bearing surface 618 are operable to contact one or more of the retention devices 606. The one or more retention devices 606, such as a series of bearings 626A-626D, can be disposed between the internal body 604 and corresponding protrusions or holes 628 in the lower cylindrical-shaped portion 610 of the housing 602. One will recognize that any number of retention devices or bearings can be used in accordance with embodiments of invention, and the selection of the number may depend on the size of the associated swivel. When the internal body 604 is moved to a first position with respect to the housing 602, similar to that shown in FIGS. 2, 3 and 5, the one or more retention devices, such as bearings 626A-626D, can contact or otherwise seat against the first position bearing surface 616 of the internal body 604. Likewise, when the internal body 604 is moved to a second position with respect to the housing 602, similar to that shown in FIG. 6, the one or more retention devices, such as bearings 626A-626D, can contact or otherwise seat against the second position bearing surface 618 of the internal body 604. Similar to that shown in FIG. 3, the relative depth of the first position bearing surface 616 is less than the depth of the second position bearing surface 618, thus when one or more bearings 626A-626D are in contact with a first bearing surface, such as 616, a portion of the bearings 626A-626D may extend outward from the protrusions or holes 628 in the lower cylindrical-shaped portion 610 and past an external surface 630 of the housing 602. Likewise, when one or more bearings 626A-626D are in contact with a second bearing surface, such as 618, a portion of the bearings 626A-626D may extend into the protrusions or holes 628 in the lower cylindrical-shaped portion 610 but remain retracted within the external surface 630 of the housing 602. Thus, when an axial force is applied to a portion of the internal body 604, such as an extended or exposed end 622 and away from the housing 602, the internal body 604 can axially translate within the axial cavity 612 between the first position and second position.

In certain embodiments, such as the embodiment shown in FIGS. 11-13, a detachable swivel 600 can include a spring 632 disposed or otherwise positioned between the biasing surface 620 of the internal body 604 and an internal surface 634 of the upper cylindrical-shaped portion 608 of the housing 602. Generally, the spring 632 is operable to bias the internal body 604 towards a first position with respect to the housing 602. When the internal body 604 is moved to a first position, similar to that shown in FIGS. 2, 3, and 5, with respect to the housing 602, the spring 632 can maintain a predefined force on the biasing surface 620 of the internal body 604 and can further maintain an opposing predefined force on the internal surface 634 of the upper cylindrical-shaped portion 608 of the housing 602. When the internal body 604 is moved to a second position, similar to that shown in FIG. 6, with respect to the housing 602, the spring 632 compresses and an increased force is applied to the biasing surface 620 of the internal body 604 and an opposing increased force is applied to the internal surface 634 of the upper cylindrical-shaped portion 608 of the housing 602.

A sling loop 636, similar to 160 in FIG. 1, can be mounted to the upper cylindrical-shaped portion 608 of the housing 602, such as to corresponding holes machined in opposing sides of the upper cylindrical-shaped portion 608.

Other embodiments of a detachable swivel and associated components can exist. Variations of the shape, dimension, organization and cooperation, and materials for various components of a detachable swivel can be understood to be within the scope of the embodiments for this invention.

FIG. 14 illustrates another example method of using a detachable swivel. The method of FIG. 14 can be used with some or all of the embodiments of a detachable swivel shown and described with respect to FIGS. 2-13.

The method 700 begins at block 702, in which a detachable swivel is inserted into an object with a groove, wherein the detachable swivel can include a housing with an axial cavity; at least one retention device; and an internal body operable to mount within the axial cavity, the internal body operable to contact the at least one retention device, wherein the internal body axially translates within the axial cavity between a first position and a second position.

In one aspect of an embodiment, a detachable swivel can include at least one spring operable to disposed between the internal body and the housing, wherein the spring biases the internal body towards the first position.

In one aspect of an embodiment, a detachable swivel can include a mounting device operable to connect to the housing.

In one aspect of an embodiment, a detachable swivel can include a mounting device operable to connect to an exposed end of the internal body when the internal body is mounted within the internal cavity.

In one aspect of an embodiment, the at least one retention device can include one or more bearings disposed between the internal body and the housing, wherein the one or bearings can extend from an outer surface of the housing when the internal body is in the first position and retract within the outer surface of the housing when the internal body is in the second position.

In one aspect of an embodiment, the first position is a locked position, and the second position is an unlocked position.

In one aspect of an embodiment, the housing is operable to mount to a corresponding hole in an object comprising at least one of the following: a firearm, a weapon, a sling, a belt, a carrying device, a garment, a safety item, a life support product, an emergency-type item, or a common household good.

Block 702 is followed by block 704, in which the groove is engaged via the at least one retention device.

Block 704 is followed by block 706, in which an axial force is applied to a portion of the internal body and away from the housing to cause the internal body to translate between the first and second position.

In one aspect of an embodiment, applying an axial force to a portion of the internal body and away from the housing can include applying an axial force to the mounting device.

Block 706 is followed by block 708, in which the detachable swivel is removed from the object or groove.

After block 708, the method 700 ends.

Other method embodiments in accordance with the invention can include fewer or greater numbers of elements and may incorporate some or all of the functionality described with respect to the components shown in FIGS. 2-13.

FIGS. 15-17 illustrate an example mount for a detachable swivel in accordance with an embodiment of the invention. The example mount 800 shown in FIGS. 15-17 can include a mounting cavity 802 in a body 804, a retention cable 806, and a set of cable end caps 808. In one embodiment, a detachable swivel similar to 200 in FIGS. 2-4, 500 in FIG. 5-6, or 600 in FIGS. 11-13, can mount in the mounting cavity 802. The mounting cavity 802 can be operable to receive an internal body associated with a detachable swivel, such as 520 in FIG. 5, wherein the internal body can include at least one retention device, such as 508 in FIG. 5, and the at least one retention device can contact a portion of the mounting cavity. The internal body can be configured to axially translate with respect to a housing associated with the detachable swivel, such as 504 in FIG. 5, wherein an axial force applied to a portion of the internal body and away from the housing causes the internal body to translate between a first and a second position. The body 804 can be a geometrically-shaped component with a loop at one end and the mounting cavity 802 or hole at an opposing end. The retention cable 806 can be threaded through two holes on opposing sides of the mounting cavity 802, and then the retention cable 806 can be mounted to a portion of a firearm or other object, and as needed, to connect the mount 800 to the firearm or other object. A set of cable end caps 808 can be mount to both ends of the retention cable 806 to secure the retention cable 806 to the mount 800 and prevent the retention cable from pulling out of either of the holes in the mount 800. As needed, the detachable swivel can be mounted or dismounted, or detached or attached, to and/or from the mounting cavity 802 by applying sufficient axial force to the detachable swivel.

In one embodiment, a mount such as 800 can be approximately 3.35 inches in length and approximately 1.59 inches in width when the retention cable is threaded into the body of the mount 800. The mounting cavity associated with the mount 800, such as 802, can be approximately 0.38 inches in diameter. Further, the retention cable associated with the mount 800, such as 806, can be approximately 0.094 inches in diameter. Other embodiments of a mount can have different dimensions and configurations.

In other embodiments, a conventional swivel such as 100 in FIG. 1 can be mounted in the mounting cavity. In certain embodiments, a mount similar to 800 in FIGS. 15-17 can be used as a mount for a detachable swivel, such as 200 in FIGS. 2-4, 500 in FIG. 5-6, or 600 in FIGS. 11-13, and/or a conventional swivel, such as 100 in FIG. 1.

FIGS. 18-19 illustrate an example sling with a detachable swivel and mount in accordance with an embodiment of the invention. In FIGS. 18-19, a sling 900 can include a detachable swivel 902, similar to 600 shown in FIGS. 11-13, mounted at one end of the sling, and a mount 904, similar to 800 shown in FIGS. 15-17, mounted at an opposing end. The sling 900 can include a forearm end 906 of material, which can be threaded through a sling loop associated with the detachable swivel 902, such as 636 in FIGS. 11-13, and a buttstock end 908 of material, which can be threaded through a loop associated with the mount 904, such as shown in 800 of FIGS. 15-17. After threading the respective ends 906, 908 of the sling 900 through the looped portions of the swivel and mount, the ends 906, 908 can be secured by respective buckles 910, 912 associated with the sling 900.

The sling 900 shown in FIG. 18 is in a detached orientation. That is, the detachable swivel 902 and the mount 904 are detached from each other. When the sling 900 is in use, the detachable swivel 902 and the mount 904 can be connected to each other as shown in FIG. 19. The associated retention cable of the mount 904 can be used to connect the mount to an object such as a firearm. Thus, the sling 900 can be used to suspend a firearm from a user's body or shoulder in a single point orientation. Other embodiments of a sling may be adapted for other or multiple point orientations.

An example method of using the sling 900 shown in FIGS. 18-19 is described as follows. In a first step, a sling with a detachable swivel and mount is provided. The detachable swivel 902 can be similar to 600 shown in FIGS. 11-13, and the mount 904 can be similar to 800 shown in FIGS. 15-17. In a subsequent step, the detachable swivel 902 can be engaged to a mounting cavity associated with the mount 904, wherein the detachable swivel 902 remains in substantial contact with the mount 904. In a subsequent step, an axial force can be applied to the detachable swivel 902 to disengage the swivel 902 from the mounting cavity associated with the mount 904, wherein the axial force applied to swivel is in a direction substantially away from a housing associated with the swivel 902.

In one embodiment, a sling 900 can be a Blue Force Gear® Vickers Combat Applications Sling™ adapted with a detachable swivel, such as 902, and a mount, such as 904. One will recognize that many different types of slings can be adapted with one or more detachable swivels and mounts in accordance with embodiments of the invention.

It will be appreciated that while the disclosure may in certain instances describe a single example embodiment of a detachable swivel and associated mount, there may be other configurations, shapes, and orientations of a detachable swivel and associated swivel components without departing from example embodiments of the invention.

One will recognize the applicability of embodiments of the invention to various objects, firearms, weapons, slings, belts, carrying devices, garments, and combinations thereof known in the art. One skilled in the art may recognize the applicability of embodiments of the invention to other environments, contexts, and applications. One will appreciate that components and elements shown in and described with respect to FIGS. 2-19 are provided by way of example only. Numerous other operating environments, system architectures, and various apparatus configurations thereof are possible. Accordingly, embodiments of the invention should not be construed as being limited to any particular operating environment, system architecture, or apparatus configuration.

Additionally, it is to be recognized that, while the invention has been described above in terms of one or more embodiments, it is not limited thereto. Various features and aspects of the above described invention may be used individually or jointly. Although the invention has been described in the context of its implementation in a particular environment and for particular purposes, its usefulness is not limited thereto and the invention can be beneficially utilized in any number of environments and implementations. Furthermore, while the methods have been described as occurring in a specific sequence, it is appreciated that the order of performing the methods is not limited to that illustrated and described herein, and that not every element described and illustrated need be performed. Accordingly, the claims set forth below should be construed in view of the full breadth of the embodiments as disclosed herein.

The claimed invention is:

1. A detachable swivel comprising:

a housing with an axial cavity;

at least one retention device; and an internal body operable to mount within the axial cavity, the internal body operable to contact the at least one retention device, wherein the internal body axially translates within the axial cavity between a first position and a second position;

a mounting device operably connected to an exposed end of the internal body when the internal body is mounted within the internal cavity, wherein the mounting device is configured to be pulled directly away from the housing so as to apply an axial force to a portion of the internal body away from the housing to causes the internal body to translate between the first and second position.

2. The swivel device of claim 1, further comprising:

at least one spring operably disposed between the internal body and the housing, wherein the spring biases the internal body towards the first position.

3. The swivel device of claim 1, further comprising:

a sling loop operable to connect to the housing.

4. The detachable swivel of claim 1, wherein the at least one retention device comprises one or more bearings disposed between the internal body and the housing, wherein the one or bearings can extend from an outer surface of the housing when the internal body is in the first position and retract within the outer surface of the housing when the internal body is in the second position.

5. The detachable swivel of claim 1, wherein the first position is a locked position, and the second position is an unlocked position.

6. The detachable swivel of claim 1, wherein the housing is operable to mount to a corresponding hole in an object comprising at least one of the following: a firearm, a weapon, a sling, a belt, a carrying device, or a garment.

7. The swivel device of claim 1, wherein the mounting device comprises at least one of: a split ring, a cotter ring, a cable, or a pull knob.

8. A detachable swivel for mounting to an object, the swivel comprising:

a housing with an axial cavity, the housing comprising one or more detent devices which can extend or retract from an outer surface of the housing, the one or more detent devices operable to mount within a circumferential groove in the object;

an internal body operable to mount within the axial cavity, the internal body operable to contact the one or more detent devices, wherein the internal body axially translates within the axial cavity between a first position and a second position, and the internal body further operable to connect to a second object;

a mounting device operably connected to an exposed end of the internal body when the internal body is mounted within the internal cavity, wherein the mounting device is configured to be pulled directly away from the housing so as to apply an axial force to a portion of the internal body away from the housing to cause the internal body to translate between the first and second position.

9. The detachable swivel of claim 8, further comprising:

at least one operably disposed between the internal body and the housing, wherein the spring biases the internal body towards the first position.

10. The detachable device of claim 8, further comprising:

a sling loop operable to connect to the housing.

11. The detachable swivel of claim 8, wherein the one or more detent devices comprises one or more bearings disposed between the internal body and the housing, wherein the one or bearings can extend from an outer surface of the housing when the internal body is in the first position and retract within the outer surface of the housing when the internal body is in the second position.

12. The detachable swivel of claim 8, wherein the first position is a locked position, and the second position is an unlocked position.

13. The detachable swivel of claim 8, wherein the object comprises at least one of the following: a firearm, a weapon, a sling, a belt, a carrying device, or a garment.

14. The detachable swivel of claim 8, wherein the mounting device comprises at least one of: a split ring, a cotter ring, a cable, or a pull knob.

15. A method for manipulating a detachable swivel with respect to an object, the method comprising:

inserting a detachable swivel into an object with a groove, wherein the detachable swivel comprises:

a housing with an axial cavity;

at least one retention device;

an internal body operable to mount within the axial cavity, the internal body operable to contact the at least one retention device; and a mounting device operably connected to an exposed end of the internal body when the internal body is mounted within the internal cavity, wherein the internal body axially translates within the axial cavity between a first position and a second position;

engaging the groove via the at least one retention device;

applying an axial force to the mounting device directly away from the housing to cause the internal body to translate between the first and second position; and removing the detachable swivel from the object or groove.

16. The method of claim 15, wherein the detachable swivel further comprises:

at least one spring operably disposed between the internal body and the housing, wherein the spring biases the internal body towards the first position.

17. The method of claim 15, wherein the at least one retention device comprises one or more bearings disposed between the internal body and the housing, wherein the one or bearings can extend from an outer surface of the housing when the internal body is in the first position and retract within the outer surface of the housing when the internal body is in the second position.

18. The method of claim 15, wherein the first position is a locked position, and the second position is an unlocked position.

19. The method of claim 15, wherein the mounting device comprises at least one of: a split ring, a cotter ring, a cable, or a pull knob.

* * * * *